US008997272B2

(12) United States Patent
Chen

(10) Patent No.: US 8,997,272 B2
(45) Date of Patent: Apr. 7, 2015

(54) WATER OUTLET STRUCTURE

(71) Applicant: Frank Kee-Suo Chen, Changhua (TW)

(72) Inventor: Frank Kee-Suo Chen, Changhua (TW)

(73) Assignee: Crescent Plumbing, Inc., Shianshi Shang, Changhua (TW)

( * ) Notice: Subject to any disclaimer, the term of this patent is extended or adjusted under 35 U.S.C. 154(b) by 187 days.

(21) Appl. No.: 13/896,861

(22) Filed: May 17, 2013

(65) Prior Publication Data

US 2014/0338767 A1 Nov. 20, 2014

(51) Int. Cl.
*E03C 1/00* (2006.01)
*E03C 1/04* (2006.01)

(52) U.S. Cl.
CPC ..... *E03C 1/0404* (2013.01); *Y10S 285/902* (2013.01)

(58) Field of Classification Search
USPC ..... 4/675–678, 695, 696; 285/902; 137/360, 801
See application file for complete search history.

(56) References Cited

U.S. PATENT DOCUMENTS 3,136,570 A * 6/1964 Lee ..... 4/678
6,840,267 B1 * 1/2005 Jennings et al. ..... 4/678
7,373,674 B1 * 5/2008 Condon ..... 4/678
8,613,294 B2 * 12/2013 Yeh ..... 4/678

* cited by examiner

*Primary Examiner* — Tuan N Nguyen
(74) *Attorney, Agent, or Firm* — Egbert Law Offices, PLLC

(57) ABSTRACT

A water outlet structure has a housing with an outlet and an opening. An inner pipe body is assembled into the housing via an assembly portion and connected to the outlet. An assembly ring flange is extended from the rear end of the inner pipe body, A locating ring inserted rotarily onto the rear end of the inner pipe body has a circumferential wall and a penetrating portion, so that said water pipe could pass through the penetrating portion, allowing its outlet end to be inserted into the inner pipe body. A leakproofing member is set between the water pipe and the locating ring or inner pipe body. A turn-lock locator is set correspondingly to the circumferential wall of the locating ring and the assembly ring flange of the inner pipe body, such that the locating ring and the inner pipe body can be rotarily locked and positioned.

5 Claims, 7 Drawing Sheets

WATER OUTLET STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an outlet structure, and more particularly to an innovative one which is designed into a water outlet structure.

2. Description of Related Art Including Information Disclosed Under 37 CFR 1.97 and 37 CFR 1.98

As a general rule, a water outlet (or hydrant) is installed at the pipe nozzle or connection. During the assembly process, the number of components and assembly method of said water outlet connector are crucial to the working efficiency, overall cost and robustness of the water pipe. So, a technical concern in this industry is how to seek for structural improvement of the water outlet connector.

Referring to FIG. 1, an existing water outlet connector generally comprises: a pipe body 01 with assembly port 02 and outlet 03, as well as a water pipe locator 04 installed at the assembly port 02 of the pipe body 01. After the water pipe 05 is inserted from the assembly port 02 of the pipe body 01, stable positioning could be realized by the water pipe locator 04. Yet, said water pipe locator 04 and the assembly port 02 of the pipe body 01 are mated by multiple screw holes 06 and screws 07 using hand tools. However, this will cause an excessive number of components, higher cost, relatively more procedures and lack of efficiency, so there is still a room for improvement of existing water outlet connector.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

Based on the innovative structural design of the present invention that the "improved water outlet structure" mainly comprises a housing, inner pipe body, locating ring, leakproofing member, turn-lock locator and water pipe locator, the sliding chute of the turn-lock locator is directly formed onto the assembly ring flange of the inner pipe body, and the locking portion is directly formed onto the circumferential wall of the locating ring. So, when the locating ring is inserted into the inner pipe body, the installers are only required to locate it with the assembly ring flange of the inner pipe body via rotation. In such a case, the number of components can be reduced, and the assembly procedures can be simplified so as to improve the working efficiency and minimize the cost with better applicability and industrial benefits.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
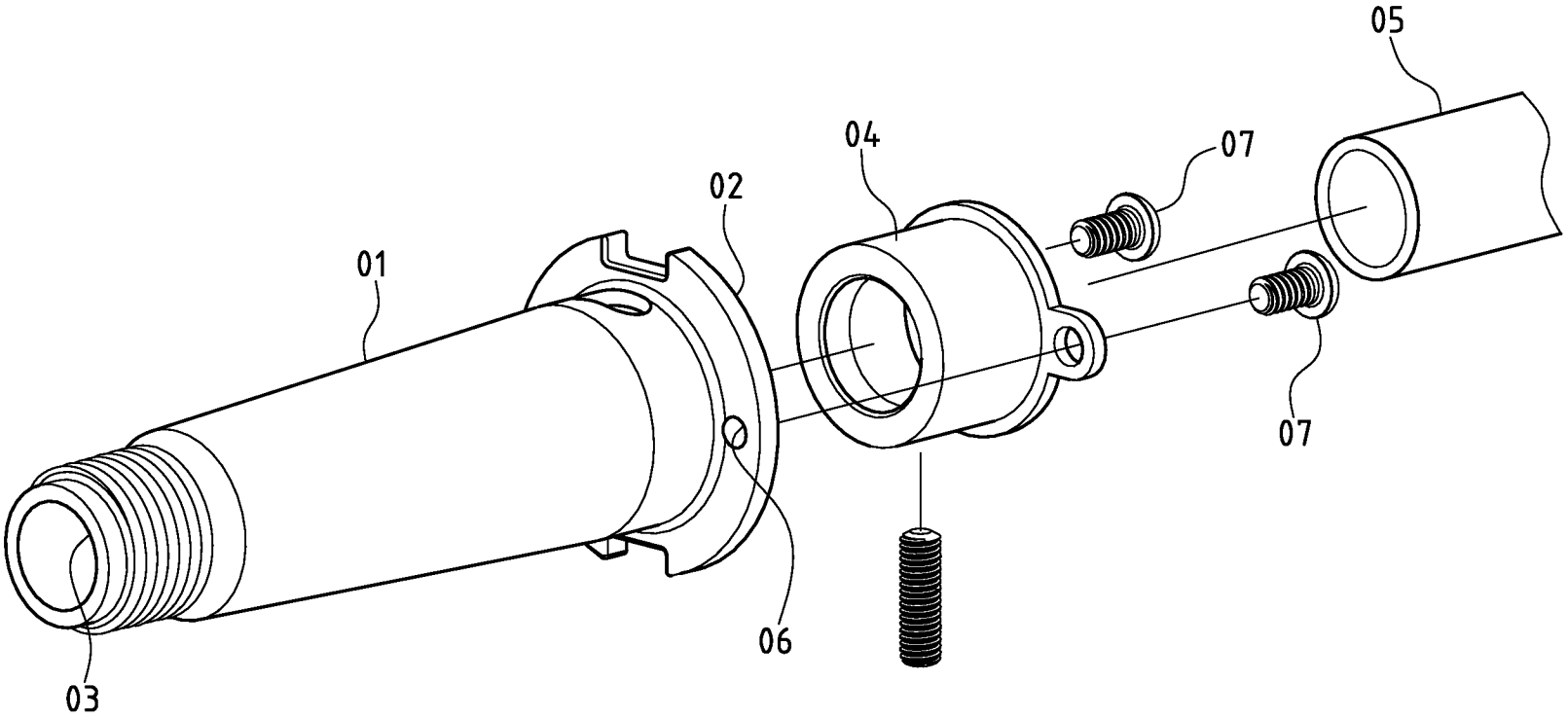
FIG. 1 is an exploded perspective view of the conventional water outlet.
Figure 2:
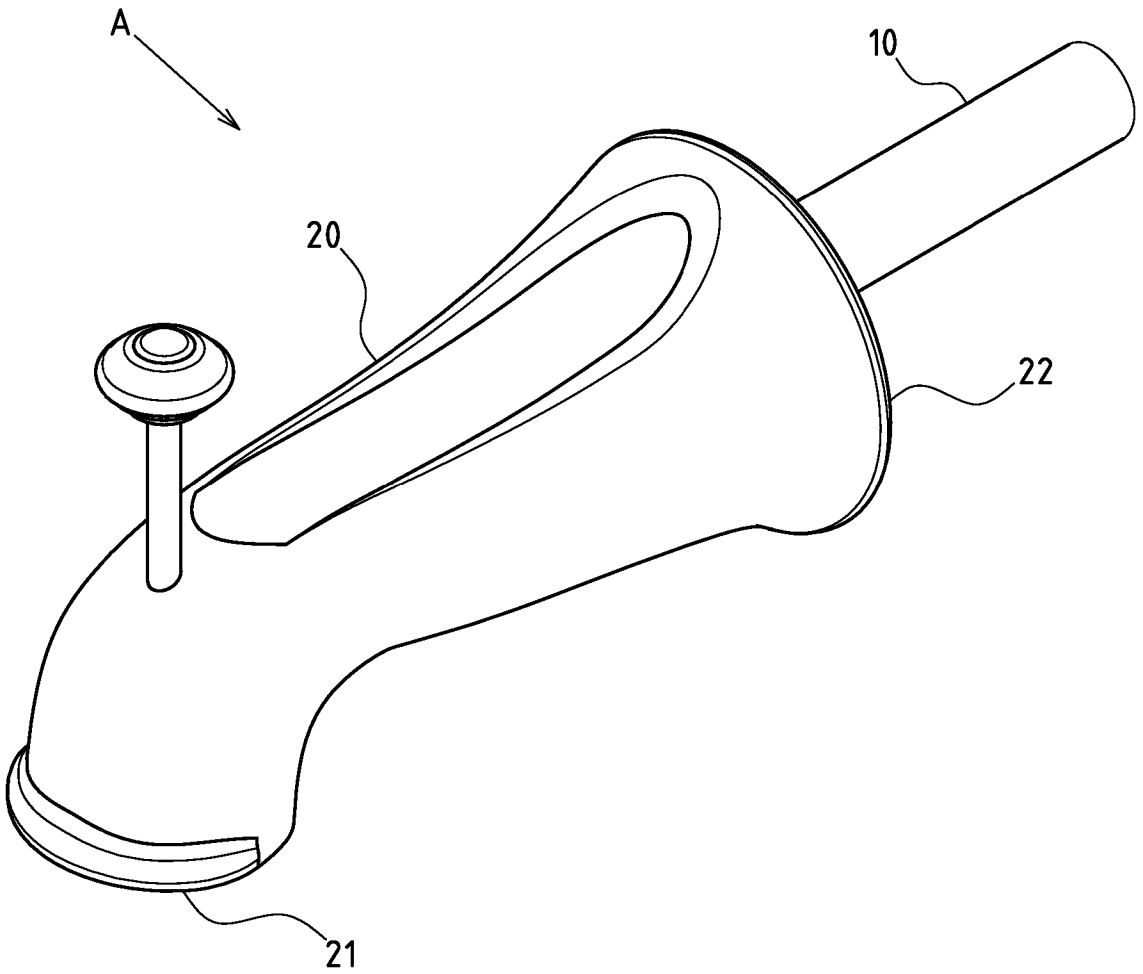
FIG. 2 is a perspective view of the preferred embodiment of the present invention.
Figure 3:
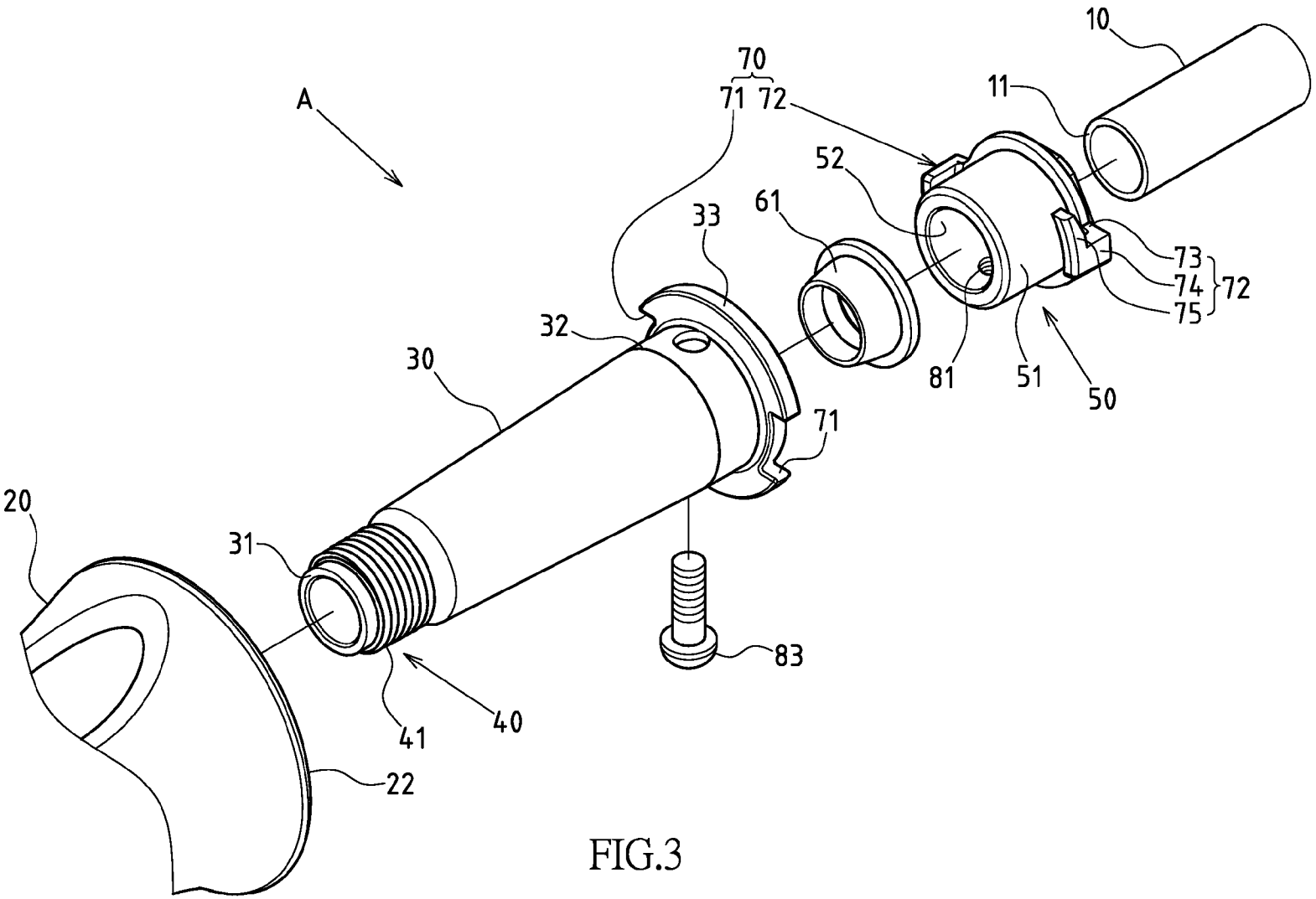
FIG. 3 is an exploded perspective view of the preferred embodiment of the present invention.
Figure 4:
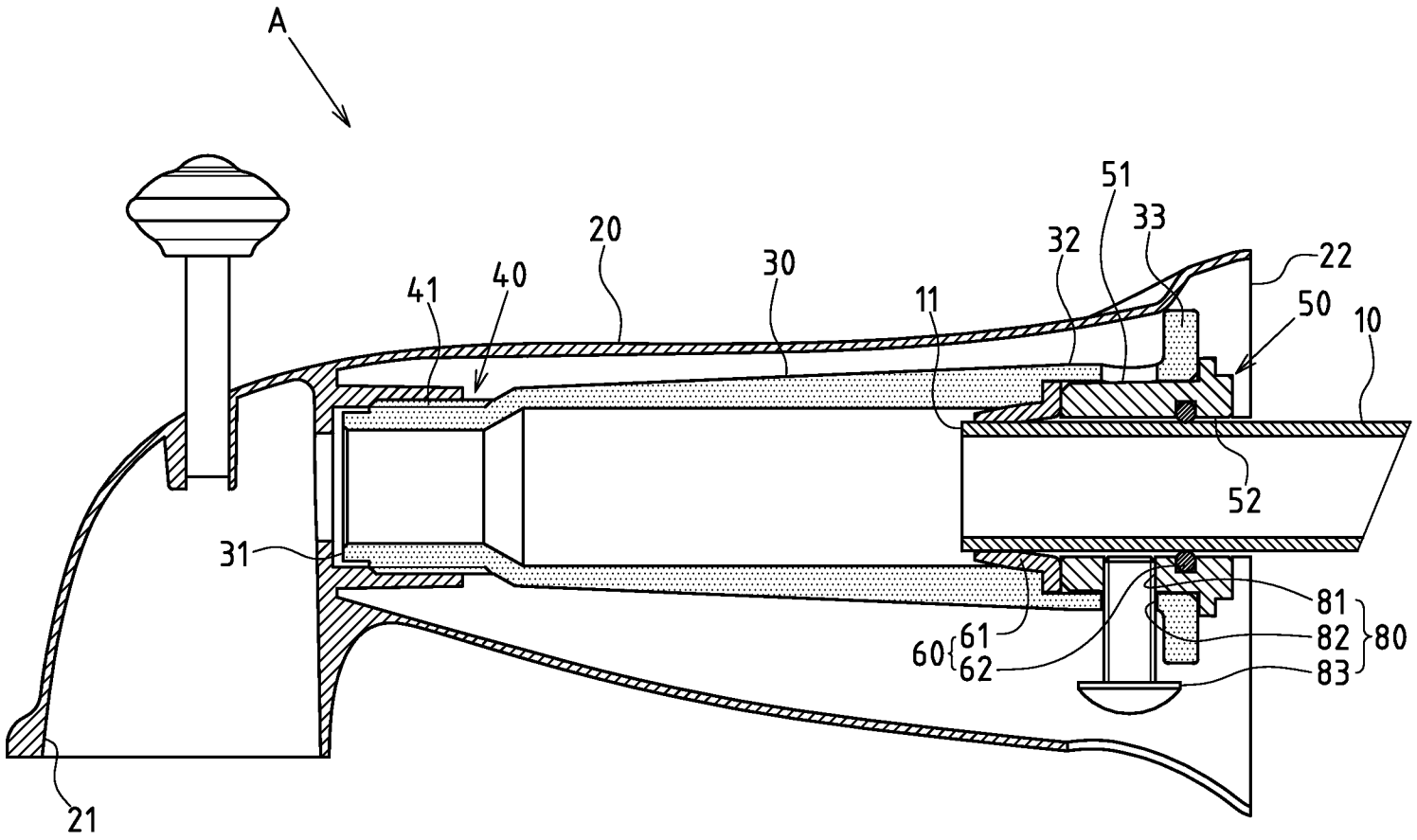
FIG. 4 is a sectional view of the preferred embodiment of the present invention.

FIGS. 2-4 depict preferred embodiments of the improved water outlet of the present invention, which, however, are provided for only explanatory objective. Said water outlet A is used for mating onto the outlet end 11 of existing water pipe 10.

Said water outlet A comprises a housing 20, formed into a cylindrical shape, and consisting of an outlet 21 at front end of the housing 20 and an opening 22 at rear end of the housing 20.

An inner pipe body 30 is assembled into the housing 20 via an assembly portion 40 and connected to the outlet 21. The inner pipe body 30 consists of a front end 31 and a rear end 32. Of which, an assembly ring flange 33 is extended from the rear end 32 of the inner pipe body 30. Referring to FIG. 4, the assembly portion 40 is composed of a screwed portion 41 set into the housing 20 at the front end of the inner pipe body 30.

A locating ring 50 is inserted rotarily onto the rear end of the inner pipe body 30, and consists of a circumferential wall 51 and a penetrating portion 52, so that said water pipe 10 could pass through the penetrating portion 52, allowing its outlet end 11 to be inserted into the inner pipe body 30 (disclosed in FIG. 4).

At least a leakproofing member 60 is set between the water pipe 10 and the locating ring 50 or inner pipe body 30, so that liquid from the water pipe 10 cannot leak. Referring to FIG. 4, the leakproofing member 60 consists of a tapered O-ring seal 61 set between the inner pipe body 30 and the locating ring 50, as well as a waterstop ring 62 set into the circumferential wall 51 of the locating ring 50. When the water pipe 10 is inserted into the inner pipe body 30, the outlet end 11 can be abutted onto the inner surface of the tapered O-ring seal 61, and the circumferential wall of the water pipe 10 abutted onto the waterstop ring 62. Alternatively, multiple waterstop rings can be adopted in cooperation with a stopper.

A turn-lock locator 70 is set correspondingly to the circumferential wall 51 of the locating ring 50 and the assembly ring flange 33 of the inner pipe body 30, such that the locating ring 50 and the inner pipe body 30 can be rotarily locked and positioned. Said turn-lock locator 70 consists of: at least two sliding chutes 71, set at opposite sides on the assembly ring flange 33 of the inner pipe body 30; a locking portion 72, protruded directly onto the circumferential wall 51 of the locating ring 50, and set correspondingly to the sliding chute 71 on the assembly ring flange 33. Said locking portion 72 consists of a protruding flange 73, an abutting flange 74 extended to the end of the protruding flange 73 and a locating flange 75 extended to the end of the abutting flange 74 with the same rotation direction as the locating ring 50. After the locating ring 50 is rotated, its abutting flange 74 can be abutted onto one end of the sliding chute 71, while the inner side of the locating flange 75 is tightly coupled with the front side of the assembly ring flange 33, so that the locating ring 50 and inner pipe body 30 are rotarily locked. Referring to FIG. 3, two sliding chutes 71 are coupled with two locking portions 72, or more than two sets can be configured.

A water pipe locator 80 is set correspondingly to the locating ring 50 and the inner pipe body 30, so that the insertion state of the water pipe 10 could be stably located. Referring to FIG. 4, the water pipe locator 80 consists of a threaded hole 81 set on the circumferential wall 51 of the locating ring 50 and a through-hole 82 set on the inner pipe body 30 correspondingly to the threaded hole 81. The water pipe locator 80 is locked into the locating ring 50 via a bolt 83, and abutted onto the circumferential wall of the water pipe 10, so that the insertion state of the water pipe 10 could be stably located.

Figure 5:
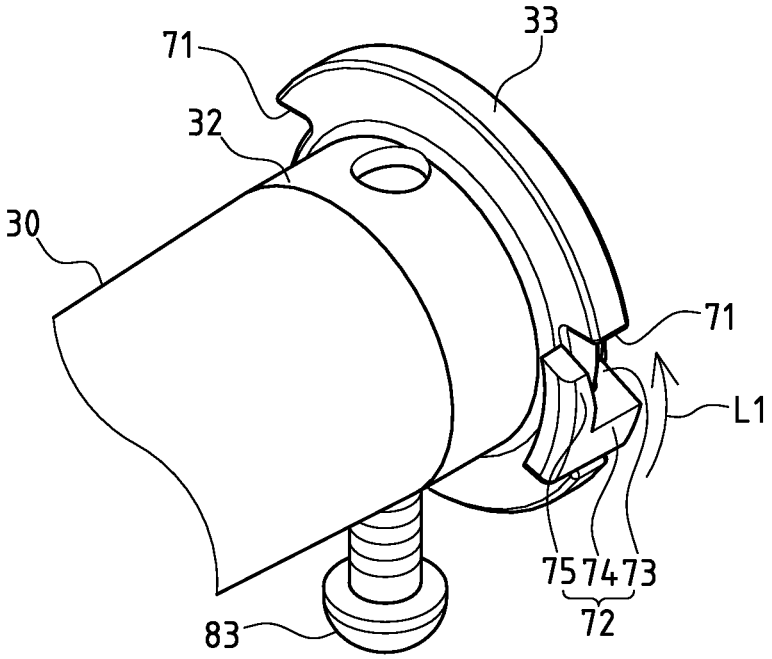
FIG. 5 is a rotary locking view of the locating ring and inner pipe body of the present invention.
Figure 6:
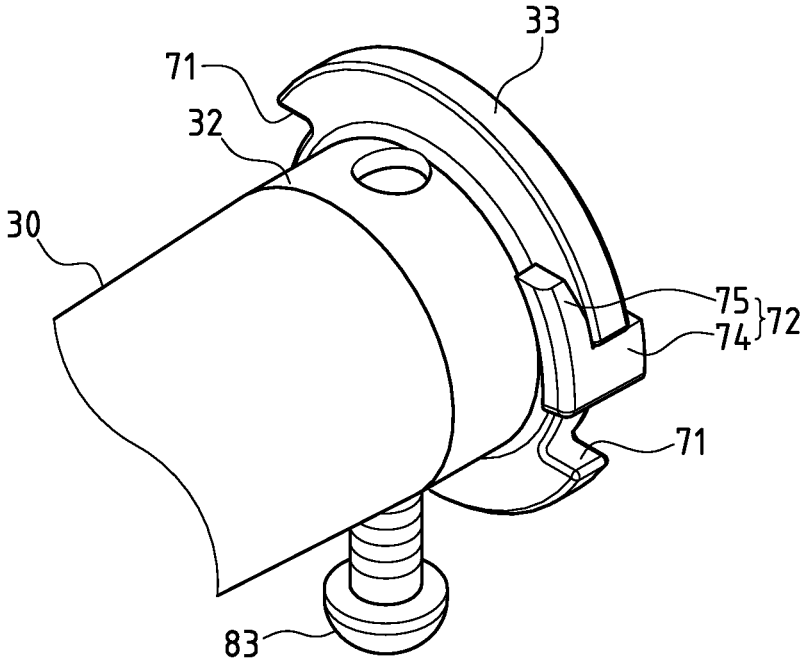
FIG. 6 is a locking view of the locating ring and inner pipe body of the present invention.
Figure 7:
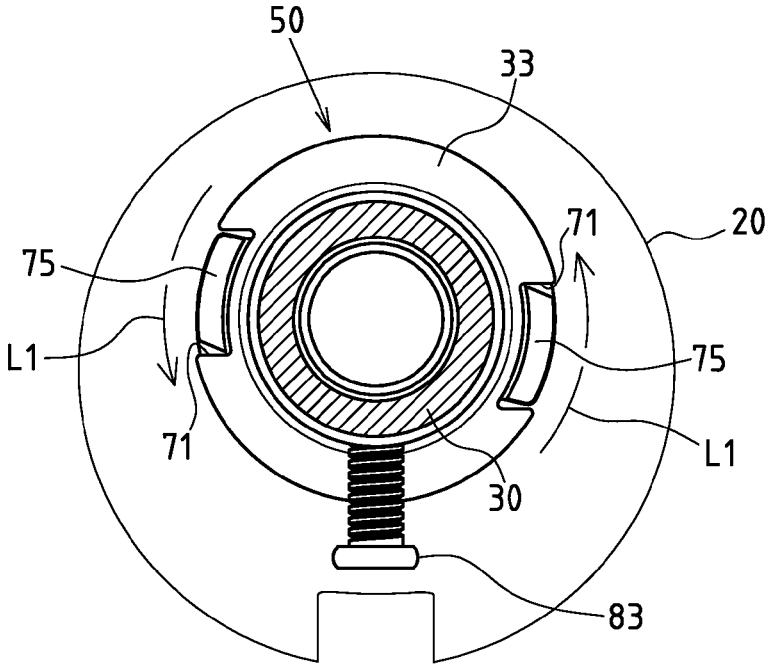
FIG. 7 is a rotary locking sectional view of the locating ring and inner pipe body of the present invention.
Figure 8:
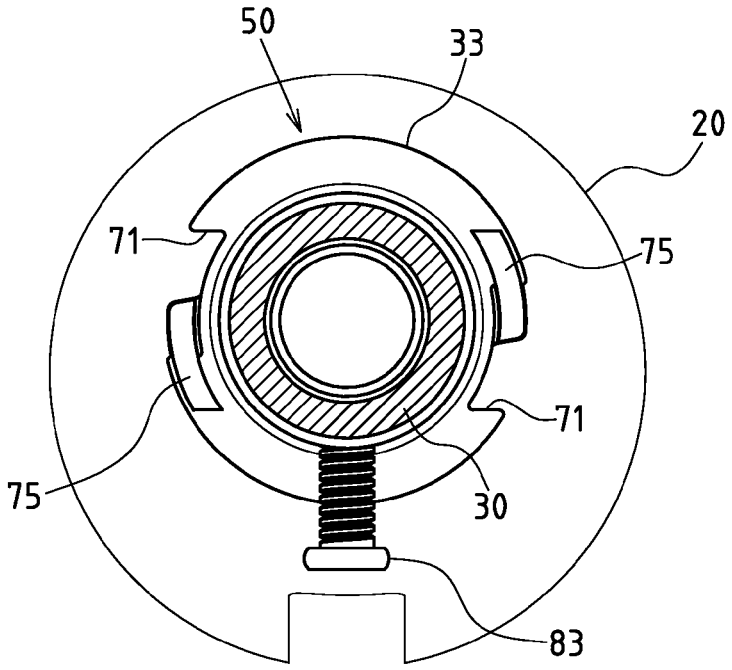
FIG. 8 is a locking sectional view of the locating ring and inner pipe body of the present invention.

Based upon above-specified structural design, the operating conditions and efficacies of the present invention are described below:

Referring to FIGS. 5 and 7, based upon the structural design wherein the sliding chute 71 of the turn-lock locator 70 is directly formed onto the assembly ring flange 33 of the inner pipe body 30, and the locking portion 72 is directly formed onto the circumferential wall 51 of the locating ring 50, the installers are only required to insert the locating ring 50 into the rear end 32 of the inner pipe body 30. The locating flange 75 of the locking portion 72 passes through the sliding chute 71, such that the abutting flange 74 is placed into the sliding chute 71, then the locating ring 50 is rotated (indicated by arrow L1 in FIGS. 5, 7) until the abutting flange 74 is abutted onto one end of the sliding chute 71. In this way, the inner side of the locating flange 75 is tightly coupled with the front side of the assembly ring flange 33, so that the locating ring 50 and inner pipe body 30 are rotarily locked and located (shown in FIGS. 6, 8). It is thus clear that said locating ring 50 could be located into the assembly ring flange 33 of the inner pipe body 30 via rotation. In such a case, the number of components (i.e.: screwed members) can be reduced, and the assembly procedures can be simplified (without hand tools) so as to improve the working efficiency and minimize the cost with better applicability and industrial benefits.

Figure 9:
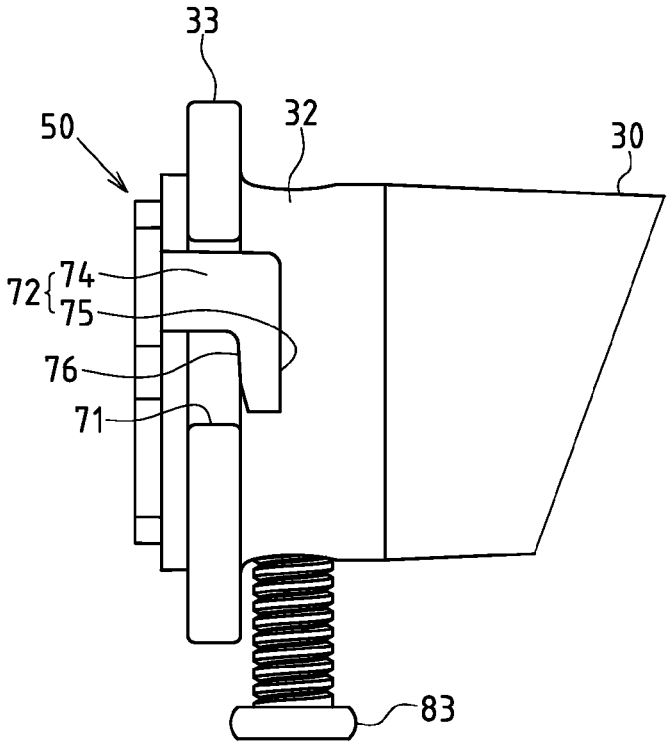
FIG. 9 is a rotary locking lateral view of the locating ring and inner pipe body of the present invention.
Figure 10:
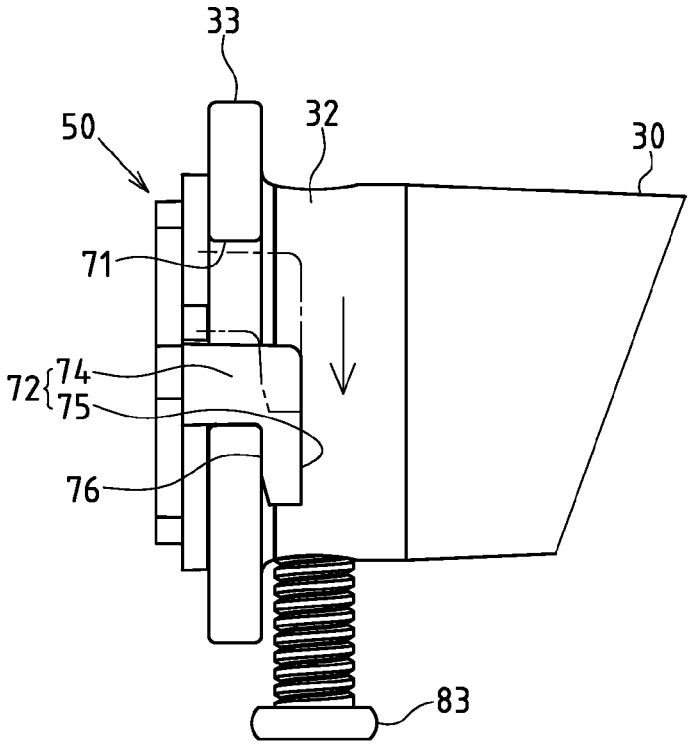
FIG. 10 is a locking lateral view of the locating ring and inner pipe body of the present invention.

Referring also to FIGS. 9 and 10, an inclined surface 76 is set on the inner side of the locating flange 75 of the locking portion 72, allowing for tighter mating with the front side of the assembly ring flange 33.

I claim:

1. An improved water outlet structure, wherein said water outlet is used for mating onto the outlet end of an existing water pipe, said water outlet comprising:

a housing, formed into a cylindrical shape, and having an outlet at front end of the housing and an opening at rear end of the housing;

an inner pipe body, assembled into the housing via an assembly portion and connected to the outlet; the inner pipe body having a front end and a rear end; of which an assembly ring flange is extended from the rear end of the inner pipe body;

a locating ring, inserted rotarily onto the rear end of the inner pipe body, and having a circumferential wall and a penetrating portion, so that said water pipe could pass through the penetrating portion, allowing its outlet end to be inserted into the inner pipe body;

at least a leakproofing member, set between the water pipe and the locating ring or inner pipe body, so that liquid from the water pipe cannot leak;

a turn-lock locator, set correspondingly to the circumferential wall of the locating ring and the assembly ring flange of the inner pipe body, such that the locating ring and the inner pipe body can be rotarily locked and positioned; said turn-lock locator comprising:

at least two sliding chutes, set at opposite sides on the assembly ring flange of the inner pipe body; and a locking portion, protruded directly onto the circumferential wall of the locating ring, and set correspondingly to the sliding chute on the assembly ring flange; said locking portion consists of a protruding flange, an abutting flange extended to the end of the protruding flange and a locating flange extended to the end of the abutting flange with the same rotation direction as the locating ring; after the locating ring is rotated, its abutting flange can be abutted onto one end of the sliding chute, while the inner side of the locating flange is tightly coupled with the front side of the assembly ring flange, so that the locating ring and inner pipe body are rotarily locked; and a water pipe locator, set correspondingly to the locating ring and the inner pipe body, so that the insertion state of the water pipe could be stably located.

2. The structure defined in claim 1, wherein an inclined surface is set on the inner side of the locating flange of the locking portion, allowing for tighter mating, with the front side of the assembly ring flange.

3. The structure defined in claim 2, wherein the leakproofing member comprises of a tapered O-ring seal set between the inner pipe body and the locating ring, as well as a waterstop ring set into the circumferential wall of the locating ring; when the water pipe is inserted into the inner pipe body, the outlet end can be abutted onto the inner surface of the tapered O-ring seal, and the circumferential wall of the water pipe abutted onto the waterstop ring.

4. The structure defined in claim 3, wherein said water pipe locator comprises a threaded hole set on the circumferential wall of the locating ring and a through-hole set on the inner pipe body correspondingly to the threaded hole; it is locked into the locating ring via a bolt, and abutted onto the circumferential wall of the water pipe, so that the insertion state of the water pipe could be stably located.

5. The structure defined in claim 1, wherein said assembly portion is composed of a screwed portion set into the housing at the front end of the inner pipe body.

* * * * *